United States Patent [19]

Hoovler et al.

[11] Patent Number: 4,600,320

[45] Date of Patent: Jul. 15, 1986

[54] PRINTER FOR PRODUCING BOTH BRAILLE CHARACTERS AND PRINTED CHARACTERS

[76] Inventors: Thomas H. Hoovler, Park School of Buffalo 4625 Harlem Rd., Snyder; Antonina Vertino, 10 Mona Dr., Eggertsville, both of N.Y. 14226

[21] Appl. No.: 675,024

[22] Filed: Nov. 26, 1984

[51] Int. Cl.[4] ..... B41J 3/32

[52] U.S. Cl. ..... 400/122; 400/662

[58] Field of Search ..... 400/122, 648, 656, 657, 400/658, 659, 662; 434/113, 114, 115

[56] References Cited

U.S. PATENT DOCUMENTS

| | | | |
|---|---|---|---|
| 422,614 | 3/1890 | Nolan | 400/122 |
| 824,088 | 6/1906 | Barr | 400/122 |
| 1,414,229 | 4/1922 | Steinkraus | 400/122 |
| 3,534,846 | 8/1978 | Watari | 400/122 |
| 4,108,066 | 10/1970 | Andersson | 400/122 X |

*Primary Examiner*—Charles A. Pearson

*Attorney, Agent, or Firm*—A. A. Saffitz

[57] ABSTRACT

A printer for producing both standard printed characters and braille characters on a recording medium comprising a platen having a cylindrical exterior recording medium surface, a braille embossing mechanism on the inside of the platen and the surface of the platen having solid and perforated regions so that on rotation of the platen the solid regions serve as a backing for standard printed characters and the perforated regions comprise holes in a 6 dot braille pattern, thereby providing for the simultaneous printing or typing of printed words and braille words. The braille characters are embossed directly below the printed characters in a one to one fashion which permits the typed correspondence to be read by the sighted and the braille embossing to be read by the blind simultaneously thereby saving time, effort and money for communicating with the blind and the sighted in the fields of entertainment, education and employment.

5 Claims, 6 Drawing Figures

PRINTER FOR PRODUCING BOTH BRAILLE CHARACTERS AND PRINTED CHARACTERS

BACKGROUND OF THE INVENTION

1. Field of the Invention

This invention is in the field of printers such as electronic or electric printers, adding machines, calculators, word processors, typewriters and the like for producing braille characters and for producing printed characters upon the same recording medium, the braille characters which are designed for the use of the blind being generally embossed in a 6 dot pattern wherein the dots consist of holes or indentations corresponding to holes.

2. Description of the Prior Art

The prior art of printing for the blind by machines creating braille dots have been known for almost 100 years and improvements in braille typewriting machines for the blind have evolved during the past 100 years to develop 6 pin elements supported on a typing base for extension and retraction in response to controlling keys for the type heads.

However, in the prior art we are not aware of any patents which provide for the extension and retraction of pins which are located within the platen itself and disposed along the surface of the platen in a direction parallel to the central axis of the platen and at the same time providing solid regions on the surface of the platen for the reception of printed characters from the standard keyboard of the typewriter, word processor, calculating machine, or the like, to provide a simultaneous side by side printing of the braille characters and the printed characters.

SUMMARY OF THE INVENTION

This invention relates to an improvement in typewriting machines and printing machines for the blind which aids communication between the blind and the sighted by producing both standard printed characters and braille characters on a recording medium in which the braille printing mechanism comprises a plurality of embossing pins and a plurality of solenoids, one solenoid being furnished for each pin so that each solenoid upon actuation drives its associated pin outwardly through a hole formed in the platen to form braille characters on the recording medium. The surface of the platen has alternating solid regions and perforated regions through which the pins are driven by the solenoid. The alternating solid region adjacent the perforated region through which the pin is driven represents the portion of the platen upon which the printed character corresponding to the braille character is typed or printed. Accordingly all of the printing operations for braille printings are carried out within the interior of the cylindrical platen while all of the standard character printing operations are carried out on the outside surface in the alternating solid regions adjacent the perforated regions of the platen. It is therefore clear that the printer for the braille characters comprising the platen of special construction with alternating solid and perforated regions and the interior braille printing actuating means located within the interior of the cylindrical platen provides a means which can convert a standard printer such as an electronic typewriter, word processor or the like into a simultaneous braille and printed character printer.

An important aspect of the present invention is the fact that the braille characters are formed on the recording medium simultaneously with the formation of the printed characters corresponding thereto and to the side thereof. The braille printing is simultaneous with the standard character printing. A preferred spacing which is shown in the present preferred embodiment and in the drawings is provided with a platen having holes spaced at double spaced vertical intervals but single spaced intervals may be used. The alignment of the braille holes in the platen face and the adjustment of the braille printing mechanism with respect to the penetration and retraction of the pins to these holes is adjusted to provide embossing of the braille characters immediately below the printed characters and thus preserving an orderly presentation of the printed communication for the sighted at the top and for the blind immediately therebelow.

DESCRIPTION OF THE PREFERRED EMBODIMENTS

Figure 1:
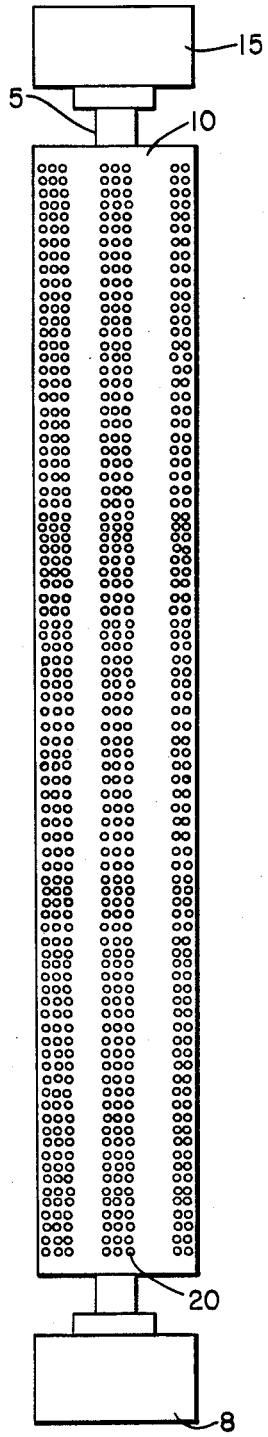
FIG. 1 is a side elevational view showing the novel platen element of the invention having the braille perforations in the specific array for the 6 dot braille characters next to inner perforated areas extending longitudinally along the outer cylindrical surface of the platen to illustrate the vertically spaced braille printing and typewriter printing zone.
Figure 2:
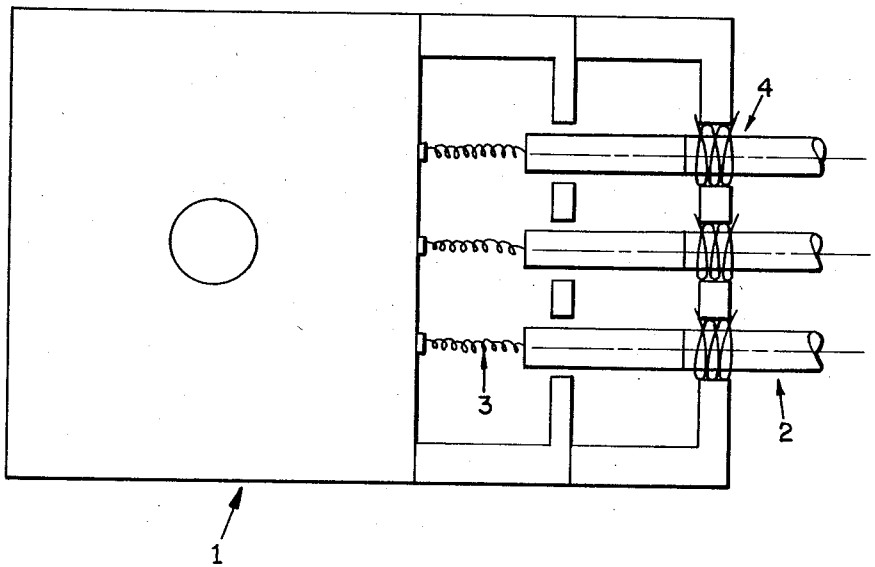
FIG. 2 shows a side elevational view partly in section of the braille actuating system comprising pins actuated by solenoids and constrained by springs.
Figure 3:
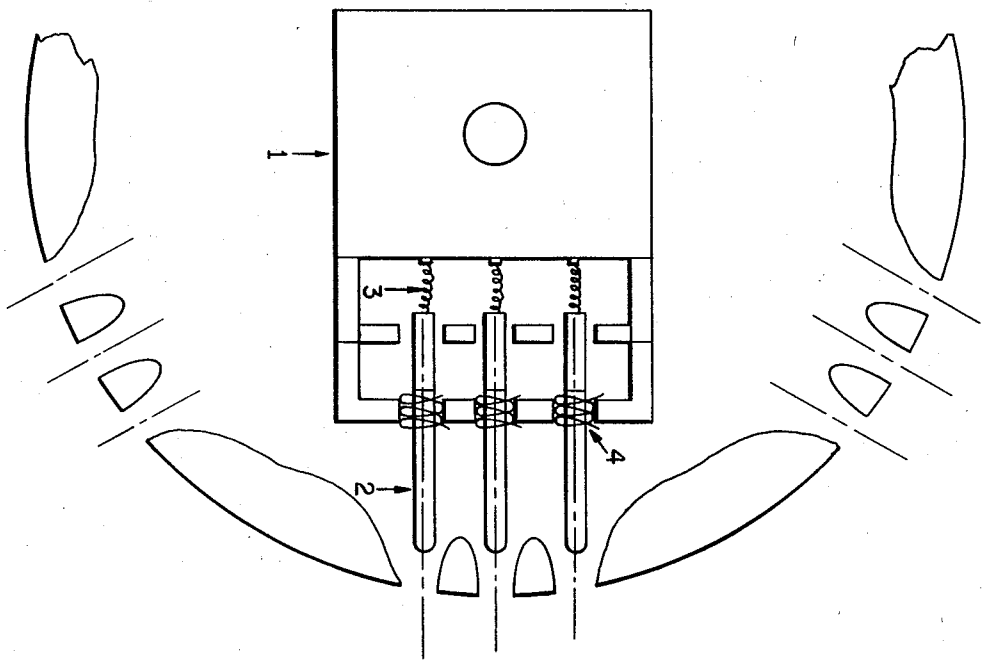
FIG. 3 shows schematically a view of the braille pin operating mechanism inside of the platen with relation to the holes or perforations in the platen and further showing how the rotation of the platen about the central axis brings an adjacent set of holes in alignment with the pins.

The preferred embodiment of the printer for producing both braille and printed characters on a conventional electric or electronic typewriter or word processor or the like is shown in FIGS. 1–6 and comprises a platen 10 having a generally cylindrical exterior recording supporting surface and perforations 20 which is shown in a longitudinal view in FIG. 1 and in a sectional view in FIG. 3 together with an internal braille printing actuating means shown in FIG. 2 which is mounted inside of the platen 10 and provided with three rows of braille embossing pins 2 cooperating with the perforations to form braille characters.

Figure 4:
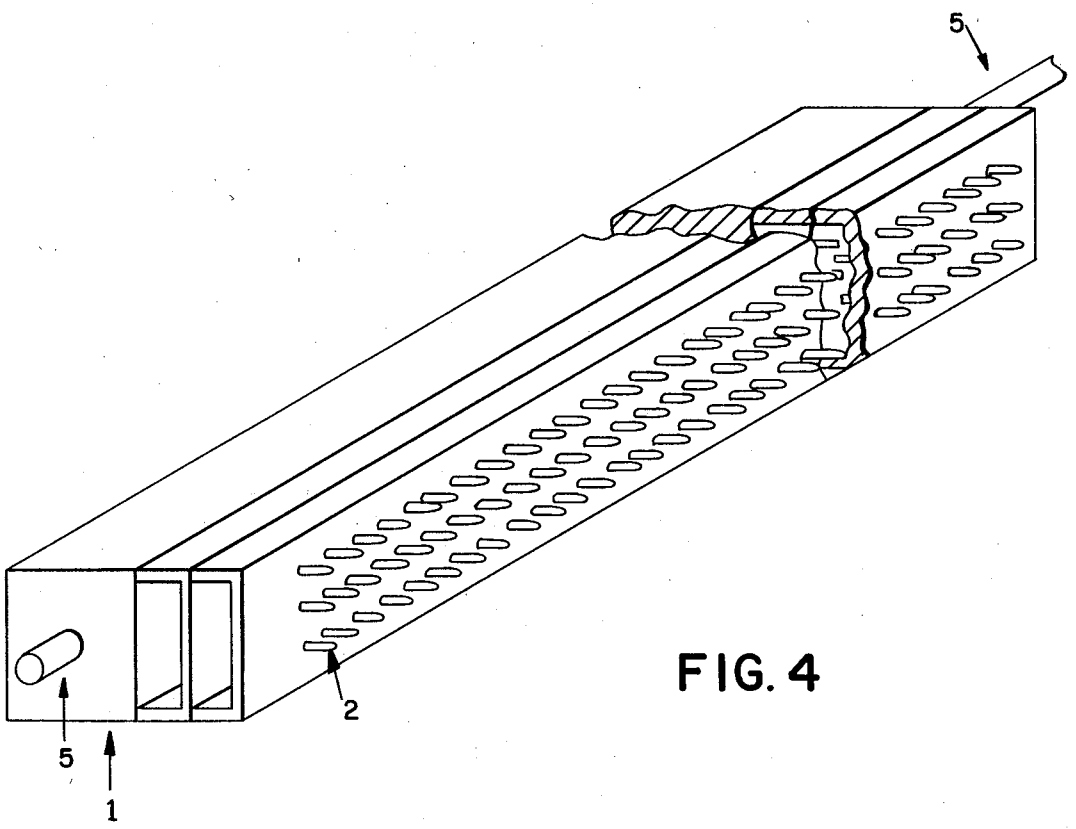
FIG. 4 is a view of the internal pin actuating mechanism adapted to be inserted with the platen and extending along the longitudinal axis of the platen in which the mechanism is held in place by means of axially replaced rods.

The platen 10 which is provided with three rows of perforations 20 corresponding to the three rows of pins 2 as shown in FIG. 3 provides for the juxtaposition of the pins 2 with respect to the holes or perforations after the pin assembly of FIG. 4 is mounted within the interior of the platen of FIG. 3. This assembly of FIG. 4 provides a presentation of pins 2 in the interior with respect to the holes in the platen so that the actuation of the solenoid 4 provides for movement of pins with six of the holes or perforations in a row to thereby create a six-dot braille character against the recording medium which is subjected to the pins in the braille printing step and is best shown in cross-section in FIG. 3.

In the particular preferred embodiment illustrated by present FIGS. 1, 3 and 4, these alternating solid regions and perforated regions are spaced apart by a distance which corresponds to double spacing on the conventional electronic typewriter. A regular printed character is printed on the platen in the conventional manner over the braille printing which is printed in the perforated region. This double space distance is a matter of choice and can be made greater or lesser providing that the simultaneous printing of standard print characters and braille characters on the recording medium is given adequate space on the recording medium to clearly distinguish these and permit easy reading.

Figure 5:
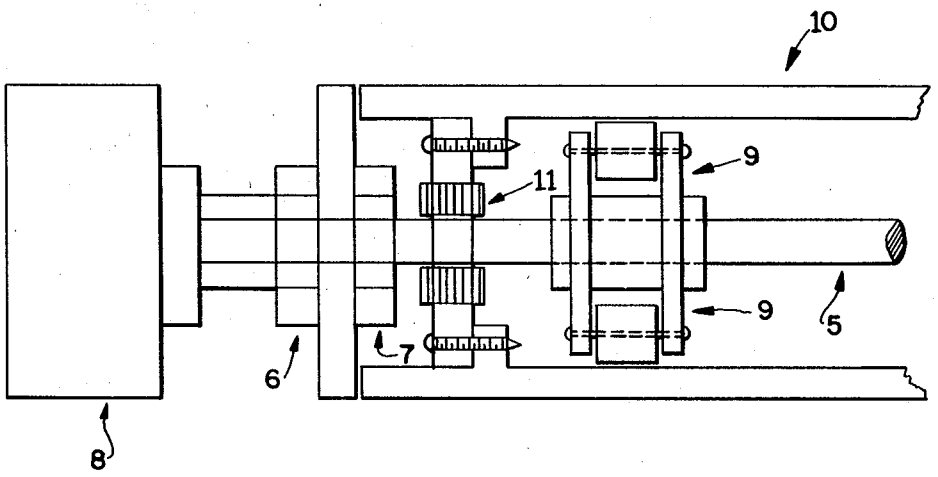
FIG. 5 is a view at the left end of the mechanism of FIG. 4 showing the mounting of the rod by bolds which constrain the left knob of the platen against moving.

The mounting of the platen cylinder 10 along the fixed axial rod 5 to the knob on the left side of the platen, namely the left platen knob 8 and the knob on the right side of the platen, namely the right platen knob 15, provides a platen which is rotatable about its central axis from the left platen knob as shown in FIG. 5.

It is a characteristic of this preferred embodiment that the internal braille printing actuating means shown in FIGS. 3 and 4 which is located within the platen be in alignment with each set of holes these sets being illustrated in FIG. 1 so that upon each rotation of the platen by the right platen knob 15 there results in the placement of a new line of braille pins for printing and the rotation is such that the pins register with the holes. In particular, note in FIG. 1 that a rotation of the platen 10 in a clockwise direction by rotating right knob 15 will bring the holes located in the upper left quadrant into opposition and registration with the pins 2. Also if the rotation is in the opposite direction, e.g. counterclockwise, then the holes in the upper right quadrant will come into registration with the pins.

Figure 6:
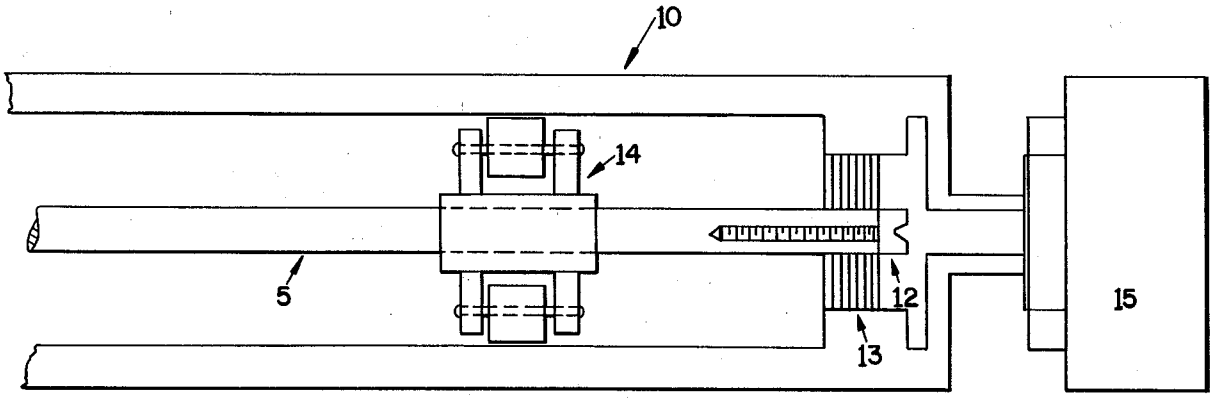
FIG. 6 is a view of the right end of the axial rod, and platen knob and a set screw which shows how the rod is held in place while the platen is free to move about it by means of a low friction collar and further shows a roller to aid the movement of the platen.

As shown in FIG. 5 where the left knob 8 of the platen is shown as being held in place by bolts 6 and 7 to thereby constrain this knob to prevent its movement, roller mechanism 9 is mounted to bear against the internal inner circumference of the platen 10 for permitting the internal rotational movement of the longitudinal platen mechanism of FIG. 4 by rotating right knob 15. At the same time an additional constraint is provided on the inside of the platen which operates to constrain the rotational movement of the axial rod 5, this further constraint consisting of a cylindrical bushing which permits relative rotation between a shaft 5 or rod 5 and the platen 10 to allow the platen to turn about the axial rod or shaft 5. In FIG. 6, the mounting of the shaft 5 is shown and the axial rod 5 is held in place with set screw means 12. A low friction collar 13 is provided which allows platen 10 to rotate about rod or shaft 5.

The invention includes for this preferred embodiment not only the internal mechanisms for alignment as explained above but also the mounting bulkhead 1 for the internal pin mechanism as shown in FIG. 2 wherein the support comprising a central bulkhead 1 serving as the essential supporting structure for the mounting of the braille embossing pins 2 which are solenoid actuated by means of solenoids 4 and constrained at their ends by means of return springs 3.

From the foregoing it is seen that each solenoid 4 of a pin 2 which is electrically actuated takes part in a braille embossing operation for a six-dot pattern in which the solenoid serves to drive the pin outwardly through one of the holes 20 formed in the platen to impart its embossing action followed by retraction of the pin 2 by means of the spring returning action for the pins 2 which is caused by the operation of spring 3 anchored to bulkhead 1 and is shown in FIG. 3 herein. Thus a group of 2×3 pins acts as a unit. At the same time that this operation of braille printing occurs, the standard typewriter action provides the standard printed character corresponding to the braille character and which is brought against the recording medium in the space which is immediaely above the line of perforations as shown in FIG. 1. Thus the printed character appears above the braille character.

It is contemplated that each time a key of the keyboard of the printing machine or typewriter is struck the electronic signal to the solenoid actuates the internal embossing mechanism within the platen which in turn actuates the appropriate embossing pins corresponding to the printed letter on the keyboard. These pins constitute a 2×3 cell constituting the braille character. For each individual group of the 2×3 array of pins which constitute the specific braille printing assembly a corresponding printed character permits proof reading. After the line is completed the platen is rotated through a double space interval. A new horizontal row of holes is presented and the internal embossing means is located for its proper function. The operation repeats itself as often as is necessary.

The solenoids may be connected to the typewriter or electronic keyboard in a conventional digital and coded fashion. The group size characters of the 2×3 sets mentioned in the last paragraph and which constitute individual six-dot braille cells are such that the braille cells are about the size of the typed letter to make for easier reading and proofing. The spacing of the groups of holes 20 in the platen 10 longitudinally from each other are preferably at half space intervals. Thus each group of holes constitutes an active horizontal face for braille printing on the platen. The anchoring of the internal embossing mechanism by the axial rod is achieved because of the direct attachment to a non-moving left platen knob and only the right side knob moves to move the platen. In the present preferred embodiment the internal mechanism is removed simply by removal of the two bolts which mount the left platen edge and the four screws for the low friction collar.

Having thus disclosed the invention, we claim:

1. A printer for producing both standard printed characters and braille characters on a recording medium, comprising:

a platen having a generally cylindrical exterior recording medium supporting surface, said platen being rotatable about its central axis, said surface having alternating solid and perforated regions, said regions extending along the surface of said platen in a direction parallel to said central axis, said solid portions serving as a backing surface for said recording medium as said standard printed characters are printed, said perforated portions comprising holes formed in six-dot braille patterns;

a braille printing actuation device located in the interior of said cylindrical platen, said actuation device comprising a base housing, a plurality of embossing pins and a plurality of solenoids housed in said base housing, one solenoid being furnished for each pin, each solenoid, upon actuation, serving to drive its associated pin outwardly through one of said holes formed in said platen so as to form braille characters in said record media at the same time that a corresponding standard character is being printed on said sheet adjacent said braille character.

2. A printer as claimed in claim 1 wherein said alternating solid and perforated regions are spaced apart a distance corresponding to double spacing for standard printed characters.

3. A printer as claimed in claim 2 wherein said platen is secured to an axial rod, a left platen knob and a right platen knob, the left platen knob is held in place by bolt means to contrain its movement and wherein roller means are provided on the inside of the platen adjacent said left platen knob to facilitate the turning movement of the platen.

4. A printer as claimed in claim 3 wherein the left end of the axial rod adjacent said left platen knob is provided with a screw means.

5. A printer as claimed in claim 1 wherein said braille printing actuating device is mounted by an axial rod and bolts within said platen and can be easily removable by removing said bolts.

* * * * *